US011087734B1

(12) United States Patent
Sun et al.

(10) Patent No.: US 11,087,734 B1
(45) Date of Patent: Aug. 10, 2021

(54) ACTIVE NOISE REDUCTION METHOD, SYSTEM, AND NEW ENERGY VEHICLE

(71) Applicant: BYD COMPANY LIMITED, Shenzhen (CN)

(72) Inventors: Yaxuan Sun, Shenzhen (CN); Yongji Zhao, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 0 days.

(21) Appl. No.: 16/759,312

(22) PCT Filed: Jun. 6, 2018

(86) PCT No.: PCT/CN2018/090099

§ 371 (c)(1),
(2) Date: Apr. 24, 2020

(87) PCT Pub. No.: WO2019/080505

PCT Pub. Date: May 2, 2019

(30) Foreign Application Priority Data

Oct. 27, 2017 (CN) ..... 201711026134.0

(51) Int. Cl.
*G10K 11/175* (2006.01)

(52) U.S. Cl.
CPC .... *G10K 11/1752* (2020.05); *G10K 2210/121* (2013.01); *G10K 2210/1282* (2013.01)

(58) Field of Classification Search
CPC ..... G10K 2210/1282; G10K 2210/121; G10K 11/1752
USPC ..... 381/71.4
See application file for complete search history.

(56) References Cited

U.S. PATENT DOCUMENTS 9,365,158 B2 * 6/2016 Barlow, Jr. ..... B60Q 9/00
2001/0006084 A1 7/2001 Yukawa et al.

FOREIGN PATENT DOCUMENTS

| | | | |
|---|---|---|---|
| CN | 101882440 | A | 11/2010 |
| CN | 102982798 | A | 3/2013 |
| CN | 103625395 | A | 3/2014 |
| CN | 104616662 | A | 5/2015 |
| CN | 104835490 | A | 8/2015 |
| CN | 105783843 | A | 7/2016 |
| CN | 206299429 | U | 7/2017 |

(Continued)

OTHER PUBLICATIONS

The World Intellectual Property Organization (WIPO) International Search Report for PCT/CN2018/090099 dated Sep. 7, 2018 6 Pages.

*Primary Examiner* — Paul Kim
(74) *Attorney, Agent, or Firm* — Anova Law Group, PLLC

(57) ABSTRACT

The present disclosure provides an active noise reduction method, a system, and a new energy vehicle. The active noise reduction method includes: obtaining a frequency of a high-frequency noise signal in an acoustic environment, constructing and generating a harmonic masking signal according to the frequency of the high-frequency noise signal, where the harmonic masking signal includes a harmonic signal and a masking signal, and the harmonic signal is a subharmonic wave of the high-frequency noise signal, and inputting the harmonic masking signal into a sound playback apparatus for playback to output a noise reduction construction sound, and performing noise reduction on the acoustic environment.

15 Claims, 5 Drawing Sheets

(56) References Cited

FOREIGN PATENT DOCUMENTS

| | | | |
|---|---|---|---|
| CN | 206475875 | U | 9/2017 |
| EP | 3040984 | A1 | 7/2016 |

* cited by examiner

ACTIVE NOISE REDUCTION METHOD, SYSTEM, AND NEW ENERGY VEHICLE

CROSS-REFERENCE TO RELATED APPLICATIONS

This application is a national phase entry under 35 U.S.C. § 371 of International Application No. PCT/CN2018/090099, filed on Jun. 6, 2018, which claims the priority of Chinese Patent Application Serial No. 201711026134.0, entitled "ACTIVE NOISE REDUCTION METHOD, SYSTEM, AND NEW ENERGY VEHICLE", filed by BYD Co., Ltd. on Oct. 27, 2017, content of all of which is incorporated herein by reference in entirety.

FIELD

The present disclosure relates to the fields of high-frequency noise reduction, and in particular, to the fields of performing active noise reduction on high-frequency motor noise of a new energy vehicle.

BACKGROUND

From the perspective of environmental protection, noise refers to sounds that affect normal study, work, and rest of people and "sounds undesired" by people in some occasions. For example, roars of machines, motor sounds and whistles of various means of transportation, din of people, and various sudden sounds are referred to as noise. From the perspective of physics, noise is sounds produced by a sounding body that vibrates irregularly. Noise pollution belongs to sensual pollution, and relates to subjective wills of people and living states of people. Therefore, the noise pollution has characteristics different from those of other pollution.

Noise usually includes low-frequency noise, intermediate-frequency noise, and high-frequency noise. Usually, noise at a frequency of 20 Hz to 200 Hz is the low-frequency noise, noise at a frequency of 500 Hz to 2 kHz is the intermediate-frequency noise, and noise at a frequency of 2 kHz to 16 kHz is the high-frequency noise. Usually, voice, sounds of walking, and common humming of people all belong to the low-frequency noise. The low-frequency noise is not harmful to physical and mental health of people in general, and is also conductive to improving work efficiency in many cases. The high-frequency noise mainly comes from industrial machines (for example, weaving machines, lathes, air compressors, air picks, and air blowers), modern means of transportation (for example, vehicles, trains, motorcycles, tractors, and airplanes), tweeters, construction sites, din of shopping malls and sports and entertainment venues, and the like. The high-intensity noise harms people's bodies, tires people, and causes negative emotions and even diseases.

Using high-frequency noise made by a motor of a new energy vehicle as an example, with rapid development of the new energy industry, it also brings us a problem of motor noise. Especially for the new energy vehicle, the high-frequency noise of the motor is a result of noise integration, including mechanical noise, electromagnetic noise, and air noise with frequencies ranging from 1 kHz to 12 kHz or higher. This high-frequency electromagnetic noise may bring strong discomfort to people. Therefore, it is necessary to control such noise.

There are two main technical solutions of eliminating noise: One is passive noise reduction, also referred to as physical noise reduction, including structural optimization, elimination of resonance, sound absorption and insulation by using damping materials, and the like. The other is active noise reduction, in which a sound signal having a phase opposite to a phase of a noise signal is generated for performing phase cancellation on low-frequency motor noise.

A conventional physical noise reduction technology of sound absorption and insulation has now become a general technology, and mainly refers to producing a noise reduction effect by using sound insulating, sound absorbing, and silencing materials. However, the physical noise reduction is limited by a heat dissipation index of the motor, can only be used in a limited way, and fails to meet ideal requirements for the high-frequency noise of the motor. On the other hand, a frequency of the motor noise is high, and a wavelength is short. Therefore, it is difficult to capture a phase of the motor noise to generate a sound wave with an inverted phase for active cancellation. Even if the motor noise can be captured, it is necessary to continuously adjust a search step size. In this way, a quantity of loops is very large, an amount of computation is very large, and implementation of an algorithm is relatively difficult. Even if the algorithm can be implemented, requirements on hardware are very high, and costs are high.

To perform noise reduction on the high-frequency noise, a lot of researches have been carried out, and several solutions have been proposed. One of the solutions is to construct a harmonic signal, and play the harmonic signal in an environment in which high-frequency noise reduction needs to be performed. In this way, noise reduction can be performed by fusing the harmonic signal with the high-frequency noise, thereby greatly improving sound quality of an acoustic environment to some extent. However, such a manner of performing high-frequency noise reduction by constructing a harmonic signal is relatively monotonous, and there is still space for further improvement of sound quality of an acoustic environment thereof.

SUMMARY

To resolve the problems that a manner of performing high-frequency noise reduction by constructing a harmonic signal is relatively monotonous, and that there is still space for further improvement of sound quality of an acoustic environment thereof, the present disclosure provides an active noise reduction method, a system, and a new energy vehicle.

According to one aspect of the present disclosure, an active noise reduction method is provided, including the following steps:

obtaining a frequency of a high-frequency noise signal in an acoustic environment;

constructing and generating a harmonic masking signal according to the frequency of the high-frequency noise signal, where the harmonic masking signal includes a harmonic signal and a masking signal, and the harmonic signal is a subharmonic wave of the high-frequency noise signal; and inputting the harmonic masking signal into a sound playback apparatus for playback, to output a noise reduction construction sound and to perform noise reduction on the acoustic environment.

The active noise reduction method disclosed by the present disclosure is applicable to performing active noise reduction in any high-frequency noise environment. On the one hand, a subharmonic signal of the high-frequency noise signal is constructed as the harmonic signal. In addition, a masking signal at a frequency close to the frequency of the high-frequency noise signal is added to the harmonic signal for masking the high-frequency noise signal. Adding a subharmonic wave can reduce a ratio of a high-frequency component of noise in an entire frequency domain, and the high-frequency component reflects an annoyance degree. Therefore, the annoyance degree is reduced. Moreover, adding the masking signal can make the high-frequency noise signal unclear, and therefore, also reduce the annoyance degree. In this way, the sound quality of the acoustic environment may be further improved. In addition, the method is simple and easy to operate and has low costs.

According to a second aspect of the present disclosure, an active noise reduction system is provided, including the followings modules:

a high-frequency noise signal frequency obtaining module, configured to obtain a frequency of a high-frequency noise signal in an acoustic environment;

a harmonic masking signal generation module, configured to construct and generate a harmonic masking signal according to the frequency of the high-frequency noise signal, where the harmonic masking signal includes a harmonic signal and a masking signal, and the harmonic signal is a subharmonic wave of the high-frequency noise signal; and a harmonic masking sound playback module, configured to input the harmonic masking signal into a sound playback apparatus for playback, to enable the harmonic masking signal to act with the high-frequency noise signal in the acoustic environment and to perform noise reduction on the acoustic environment.

The active noise reduction system disclosed by the present disclosure is applicable to performing active noise reduction in any high frequency noise environment. On the one hand, a subharmonic signal of the high-frequency noise signal is constructed as the harmonic signal. In addition, a masking signal at a frequency close to the frequency of the high-frequency noise signal is added to harmonic signal for masking the high-frequency noise signal. Adding a subharmonic wave can reduce a ratio of a high-frequency component of noise in an entire frequency domain, and the high-frequency component reflects an annoyance degree. Therefore, the annoyance degree is reduced. Moreover, adding the masking signal can make the high-frequency noise signal unclear, and therefore, also reduce the annoyance degree. In this way, the sound quality of the acoustic environment may be further improved. In addition, the system is simple and easy to implement and has low costs.

According to a third aspect of the present disclosure, a new energy vehicle is provided, where the new energy vehicle includes the active noise reduction system. Because the new energy vehicle disclosed by the present disclosure is provided with the active noise reduction system, active noise reduction can be performed on high-frequency motor noise of the new energy vehicle. On the one hand, a subharmonic signal of the high-frequency noise signal is constructed as the harmonic signal. In addition, a masking signal at a frequency close to the frequency of the high-frequency noise signal is added to harmonic signal for masking the high-frequency noise signal. Adding a subharmonic wave can reduce a ratio of a high-frequency component of noise in an entire frequency domain, and the high-frequency component reflects an annoyance degree. Therefore, the annoyance degree is reduced. Moreover, adding the masking signal can make the high-frequency noise signal unclear, and therefore, also reduce the annoyance degree. In this way, the sound quality of the acoustic environment in the new energy vehicle may be further improved. In addition, the system is simple and easy to implement and has low costs.

Figure 1:
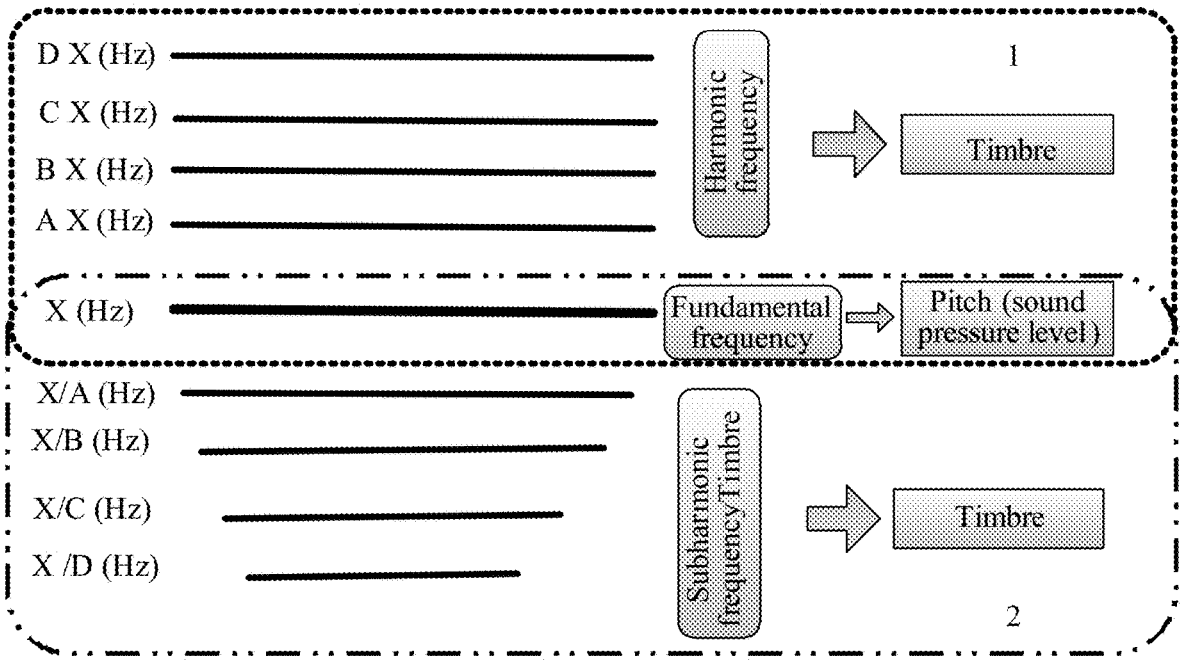
FIG. 1 is a schematic construction diagram of a harmonic signal according to a specific implementation of the present disclosure.

Reference numerals: 1. high frequency noise signal frequency obtaining module; 2. harmonic masking signal generation module; 3. harmonic masking sound playback module; 21. harmonic signal generation submodule; 22. masking signal generation submodule; 23. compounding submodule; 100. active noise reduction system; 1000. new energy vehicle.

DETAILED DESCRIPTION

To make the technical problems, technical solutions and beneficial effects of the present disclosure clearer, the present disclosure is described in further detail below with reference to the accompanying drawings. It should be understood that the specific embodiments described herein are merely used to explain the present disclosure but are not intended to limit the present disclosure.

It is found in a research process that noise reduction on high-frequency noise is a complex process. Using motor noise as an example, a high-frequency noise signal of a motor is a complex signal, and includes mechanical noise, electromagnetic noise, and air noise. Although a conventional physical noise reduction technology is mature, only some motor noise signals can be processed. Active noise reduction can cancel only some low-frequency noise signals by using an active noise control (ANC) technology. For high-frequency noise signals, currently, there is no public report about cancellation by using the ANC technology. A method in the present disclosure is different from an idea of an existing noise processing method. The method is to construct a harmony and form "harmonic noise". That is, noise not only exists, but also is still heard by people. The present disclosure further perfects and supplements a related method and mechanism of harmony construction.

There are two aspects of understanding perception of a sound: whether the sound is noisy or not and whether the sound is pleasant to hear or not. In the past, conventional noise processing focuses on whether the sound is noisy or not. When a sound pressure level is high, the sound is considered to be noisy. Therefore, the processing concerning whether the sound is noisy or not mainly focuses on a physical noise reduction means. With improvement of quality of people's life, simply paying attention to whether the sound is noisy or not cannot meet needs of people, so an increasing quantity of people begin to pay attention on whether the sound is pleasant to hear or not.

As shown in FIG. 1, a dashed-line box at an upper part in FIG. 1 shows a composition principle of vocal music in musical acoustics. In the musical acoustics, a sound (also noise) that is heard includes two parts, a fundamental wave and a harmonic wave (overtone). Usually, a frequency of the harmonic wave (for distinguishing, harmonic frequency for short) is an integral multiple of a component of a frequency of the fundamental wave (for distinguishing, fundamental frequency for short). For example, if the fundamental frequency is X Hz, the harmonic frequency is AX Hz, BX Hz, CX Hz, DX Hz, or the like, where A, B, C, and D are all positive integers. That is, the harmonic frequency is an integer multiple of the fundamental frequency. The fundamental frequency determines pitch, and the harmonic frequency determines a timbre. The pitch determines whether the sound is "loud" or not, and the timbre determines whether the sound is "nice" or not, or "pleasant to hear" or not (certainly, they are results of interaction, there is no such simple single correspondence, and the description herein is for better understanding). This can explain why a center frequency of a treble of a singer is similar to a center frequency of "squeaking" generated by a metal object streaking across glass, but subjective feelings are different. The overtones of the two are different.

In a new energy vehicle, a frequency of motor noise is usually very high. If a harmonic component of the motor noise is constructed according to the principle of the musical acoustics, the subjective feeling may be improved. However, due to an increase of a high-frequency component, an annoyance degree is also increased, and an objective of improving environmental sound quality cannot be achieved.

Therefore, reverse thinking is carried out. As shown in a dashed-line box at a lower part in FIG. 1, a fractional harmonic (subharmonic for short) component of a high-frequency signal is added as a harmonic signal. For example, if the fundamental frequency of a high-frequency noise signal is X Hz, a frequency of the subharmonic wave is X/A Hz, XB Hz, X/C Hz, X/D Hz, or the like when the constructed and generated subharmonic is as the harmonic signal. A construction mechanism is still a related principle of the musical acoustics. The difference is that the integer multiple becomes a multiple of an integer fraction, and a change of a length indicates a difference of a sound pressure level of a subharmonic wave, corresponding to a difference of an amplitude of a signal. (Based on a large quantity of experiments, it is found that when an amplitude of the harmonic signal decreases linearly in sequence, the subjective feeling of the harmony is the best.). In the subjective feeling, an effect of adding the subharmonic wave is the same as that of adding the harmonic wave, both can improve the sound quality, and their explanations are the same in a physical mechanism. That is, possibilities of coincidence of two signals are the same. For example, if the fundamental frequency is 5000 Hz, and the harmonic frequency is 10000 Hz, the harmonic wave coincides with the fundamental frequency once every two vibrations, and a ratio of the harmonic frequency to the fundamental frequency is 2:1. If the fundamental frequency is 5000 Hz, and the subharmonic component is 2500 Hz, the fundamental frequency coincides with the subharmonic once every two vibrations, a ratio of the fundamental frequency to the subharmonic frequency is 2:1. The two are the same. In psychoacoustics, when a subharmonic wave of a motor high frequency signal is added, a ratio of a high-frequency component in an entire frequency domain is reduced, and the high-frequency component reflects an annoyance degree. Therefore, the annoyance degree is reduced. The same fundamental frequency is formed by many different harmonic waves, so does the subharmonic wave, and a harmonic wave may further be formed by many different orders. In the musical acoustics, the fundamental frequency includes second and fourth harmonic components that are the most consonant. In the new energy vehicle, it is verified through experiments that the harmony component including the fourth harmonic has the greatest effect on improving the sound quality.

The so-called sound pressure level is an indicator of a magnitude of sound pressure. The sound pressure is a change of atmospheric pressure caused by a sound wave perturbation, that is, excess pressure of the atmospheric pressure, and is equivalent to a pressure change caused by superimposing a sound wave perturbation on the atmospheric pressure. The sound wave is a pressure change amount caused by a vibration when passing through a medium. The sound wave changes over time, and measured sound pressure is an effective value of the sound wave. The unit is pascal (Pa). The sound pressure level is represented by 20 times a common logarithm of a ratio of sound pressure P of a sound to a basic pressure value P0, that is, 201 gP/P0, and the unit is decibel (dB).

In the musical acoustics, in a standard tone, a frequency A of a one-line unaccented octave is 440 Hz, and a frequency A of a two-line unaccented octave is 880 Hz. It can be seen that a frequency ratio of a perfect octave is 2:1. That is, when the octave is played, two strings vibrate, the treble coincides with the bass once every two vibrations. (If it is explained herein by using the subharmonic wave principle: the fundamental frequency signal coincides with the harmonic signal once every two vibrations.) A coincidence rate is so high that it sounds harmonious. A basis in the physics is that if the coincidence ratio in harmonic energy is higher, it is more harmonious (a perfect consonant interval in a music theory includes perfect unison, perfect octave, perfect fifth, and perfect fourth. Frequency ratios of other intervals are that: minor second is 16:15, major second is 9:8, minor third is 6:5, major third is 5:4, perfect fourth is 4:3, augmented fourth is 45:32, diminished fifth is 64:45, perfect fifth is 3:2, minor sixth is 8:5, major sixth is 5:3, minor seventh is 16:9, major seventh is 5:27, and the like.

Knowing the above-mentioned relevant knowledge of psychoacoustics and music acoustics, a harmonic signal can be constructed by using a subharmonic wave, and scientificity and accuracy can be ensured. A frequency composition that causes discomfort is first determined (in a working state of the motor, there is usually a high frequency signal in a vehicle) when a subharmonic wave is constructed, and interval construction is performed on the subharmonic wave according to the musical acoustic harmony composition. Rules are obtained through a large quantity of experiments, and a fourth subharmonic wave, a third subharmonic wave, and a second subharmonic wave are generated (for example, if a fundamental frequency signal is at 1000 Hz, the fourth subharmonic wave for generating the octave is at 500 Hz, 250 Hz, 125 Hz, and 62.5 Hz; the third subharmonic wave is at 500 Hz, 250 Hz, and 125 Hz; and the second subharmonic wave is 500 Hz and 250 Hz). Harmonic components corresponding to a pitch change are generated respectively, and the pitch change is usually three types: keeping unchanged, decreasing linearly, and increasing linearly. In this way, the interval of the octave may generate 9 different harmonic components, the fourth subharmonic wave is finally selected after subjective evaluation of organized people, and a harmony combination with a linearly decreasing pitch is the best.

In addition, in later experiments and researches, it is found that when the foregoing harmony construction is performed, a sound signal at a frequency close to a frequency of a target sound is added into the target sound. For the sake of distinction, it is referred to as a masking signal. After the masking signal is added, a degree of improvement in subjective feeling is even greater.

Based on the above-mentioned principle explanation, a novel method and system for performing noise reduction on a high-frequency noise signal is provided after a large quantity of experimental verifications, and are applied to new energy vehicles. Explanations are provided below one by one through embodiments.

Figure 2:
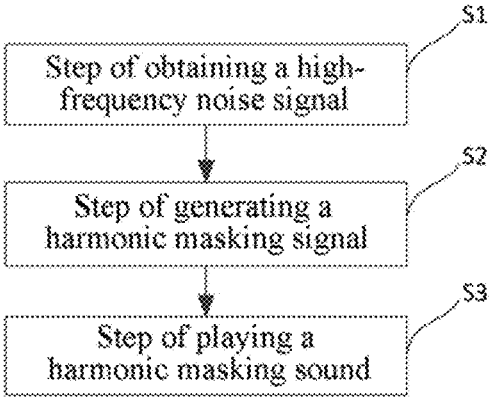
FIG. 2 is a schematic flowchart of an active noise reduction method according to a specific implementation of the present disclosure.

A first embodiment of the present disclosure discloses an active noise reduction method. As shown in FIG. 2, the active noise reduction method includes the following steps:

Step S1, a step of obtaining a high-frequency noise signal: Obtain a frequency of a high-frequency noise signal in an acoustic environment.

Step S2, a step of generating a harmonic masking signal: Construct and generate a harmonic masking signal according to the frequency of the high-frequency noise signal, where the harmonic masking signal includes a harmonic signal and a masking signal.

Step S3, a step of playing a harmonic masking sound: Input the harmonic masking signal into a sound playback apparatus for playback (e.g., a sound playing device for playing), to enable the harmonic masking signal to act with the high-frequency noise signal in the acoustic environment and to perform noise reduction on the acoustic environment.

Steps S1 to S3 are explained below one by one.

Regarding how to obtain the frequency of the high-frequency noise signal in the acoustic environment in step S1, it is not particularly limited in this embodiment, and can be obtained through a method known to a person skilled in the art.

The so-called acoustic environment refers to a system formed by all sounds in a specific area. Using a new energy vehicle as an example, an acoustic environment of the new energy vehicle refers to an environment inside the new energy vehicle. Specifically, in this example, the acoustic environment refers to a space in which a driver and a passenger are located, for example, in a cab (or in a passenger cab, the effects are equivalent) or in a motor compartment.

The so-called acoustic environmental noise refers to noise felt by a driver or a passenger in the acoustic environment, and is specifically captured by an acoustic environmental noise capturing apparatus. On the one hand, the acoustic environmental noise includes high-frequency noise from a motor, referred to as motor noise. Through researches on a high-frequency motor noise of the new energy vehicle, it is found that when a rotational speed of motor reaches a specific value, a howling sound is generated. A frequency of the howling sound may be divided into two types in general. One type is a constant frequency, referred to as a constant-frequency howl, and the other type is a variable frequency, referred to as a variable-frequency howl. The two types of howls are both high-frequency motor noise. On the other hand, the acoustic environmental noise further includes other non-motor noise, such as road noise, tire noise, and structural vibration noise. A frequency of the non-motor noise is relatively low.

Figure 3:
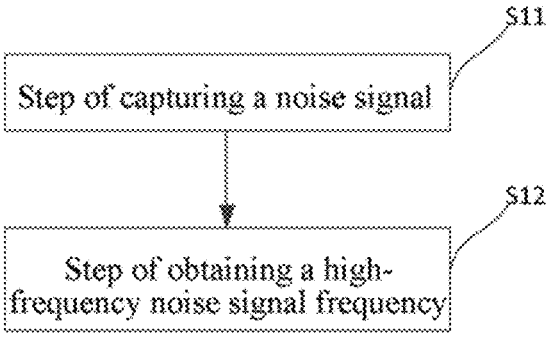
FIG. 3 is a specific schematic flowchart of step S1 in FIG. 2.

In this example, as shown in FIG. 3, step S1 may be implemented in the following ways.

Step S11, a step of capturing a noise signal: Capture acoustic environmental noise in an acoustic environment, to obtain a noise signal.

Step S12, a step of obtaining a high-frequency noise signal frequency: Extract a high-frequency noise signal from the noise signal, to obtain a frequency of the high-frequency noise signal.

Using the new energy vehicle as an example, the acoustic environmental noise includes high-frequency noise from a motor, referred to as motor noise. Through researches on a high-frequency motor noise of the new energy vehicle, it is found that when a rotational speed of motor reaches a specific value, a howling sound is generated. A frequency of the howling sound may be divided into two types in general. One type is a constant frequency, referred to as a constant-frequency howl, and the other type is a variable frequency, referred to as a variable-frequency howl. The two types of howls are both high-frequency motor noise. On the other hand, the acoustic environmental noise further includes other non-motor noise, such as road noise, tire noise, and structural vibration noise. A frequency of the non-motor noise is relatively low.

In this way, the high-frequency noise signal may be extracted in real time, and the frequency of the high-frequency noise signal is analyzed by using a frequency spectrum. This way is applicable to all occasions. Commonality is good, but also has disadvantages. For example, the acoustic environment is complex, a background signal is strong, and an effect of extracting the high-frequency noise signal is not ideal.

For noise sources making high-frequency noise, related operational parameters of the noise sources making the high-frequency noise in the acoustic environment are captured, and corresponding frequencies of the high-frequency noise signals are obtained according to the operational parameters, where the operational parameters and the frequencies of the high-frequency noise signals have a correspondence. The operational parameters corresponding to the high-frequency noise are analyzed, a one-to-one correspondence between the operational parameters and the frequencies of the high-frequency noise signals may be established in advance, and the operational parameters of the noise sources are obtained, that is, the frequencies of the high-frequency noise signals are obtained. This way of obtaining the frequency is better.

For example, an example in which the noise source is a new energy vehicle is used. High-frequency noise signals of the new energy vehicle may be obtained through the following steps: capturing operational parameters of the new energy vehicle, and obtaining frequencies of the high-frequency noise signals associated with the operational parameters according to the operational parameters, where the operational parameters include at least a rotational speed of motor of the new energy vehicle, and the rotational speed of motor and the frequencies of the high-frequency noise signals have a correspondence.

In the embodiment of the present disclosure, the operational parameters can be captured by reading data information transmitted by a CAN bus of the new energy vehicle. Optionally, the operational parameters of the new energy vehicle further include a speed of the new energy vehicle, throttle opening, and the like.

Specifically, a relationship between the rotational speed of motor and the frequency of the high-frequency noise signal (that is, motor noise signal) of the rotational speed of motor may be stored in advance. When the operational parameters are captured, the CAN bus of the new energy vehicle may be accessed, and the operational parameters, such as the rotational speed of motor, the speed, and the throttle opening, may be obtained by reading data transmitted by the CAN bus of the new energy vehicle. Further, the relationship between the rotational speed of motor and the frequency of the motor noise signal that is stored in advance may be obtained through the CAN bus, and a corresponding frequency of the motor noise signal is obtained according to the rotational speed of motor.

Specifically, an example in which the operational parameter is the rotational speed of motor is used for description. In different working conditions, the rotational speed of motor of the new energy vehicle and the motor noise signal corresponding to the rotational speed of motor may be captured, frequency domain analysis may be performed on the captured motor noise signal by using a frequency spectrum analyzer to obtain frequency spectrum characteristic information, such as a frequency and a sound pressure level, of the motor noise signal, and further to obtain a correspondence between the rotational speed of motor and the frequency and the sound pressure level of the motor noise signal.

Figure 4:
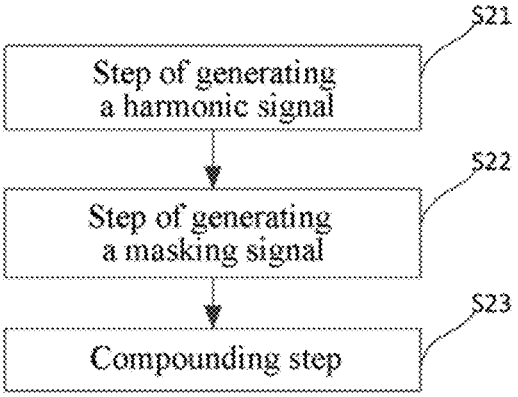
FIG. 4 is a specific schematic flowchart of step S2 in FIG. 2.

As shown in FIG. 4, in this example, the step S2 specifically includes the following steps.

S21, a step of generating a harmonic signal: Construct and generate a harmonic signal according to the frequency of the high-frequency noise signal.

S22, a step of generating a masking signal: Construct and generate a masking signal according to the frequency of the high-frequency noise signal.

S23, a compounding step: Compound the harmonic signal and the masking signal to obtain the harmonic masking signal.

The constructing and generating a harmonic signal in step S21 is not particularly limited.

For example, manner 1 is adopted: Obtain, according to the frequency of the high-frequency noise signal, the harmonic signal corresponding to the high-frequency noise signal by invoking a preset sound construction database.

Alternatively, manner 2 is adopted: Obtain, according to the frequency of the high-frequency noise signal, the harmonic signal corresponding to the motor noise signal by using a generating function.

The following describes the manner 1 and the manner 2 respectively.

Figure 5:
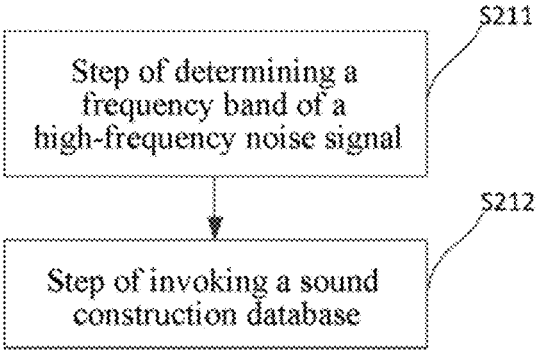
FIG. 5 is a specific schematic flowchart of step S21 in FIG. 4.

As shown in FIG. 5, in the manner 1, the harmonic signal is constructed and generated through the following steps.

Step S211, a step of determining a frequency band of a high-frequency noise signal: Determine a frequency band of the high-frequency noise signal according to the frequency of the high-frequency noise signal.

Step S212, a step of invoking a sound construction database: Invoke the preset sound construction database according to the frequency band of the high-frequency noise signal, to obtain a harmonic signal corresponding to the frequency band of the high-frequency noise signal, where the preset sound construction database stores a plurality of harmonic signal samples, and each harmonic signal sample corresponds to a noise frequency band, and includes the harmonic signal corresponding to the noise frequency band.

Specifically, in an example, if a value of the frequency of the motor noise signal obtained by using the rotational speed of motor is 4000 to 5000 Hz, the motor noise signal is a high-frequency noise signal, and the preset sound construction database may be invoked through the CAN bus. The harmonic signal corresponding to the high-frequency signal may be obtained, for example, the harmonic signal at a low frequency of 600 to 1000 Hz.

Figure 6:
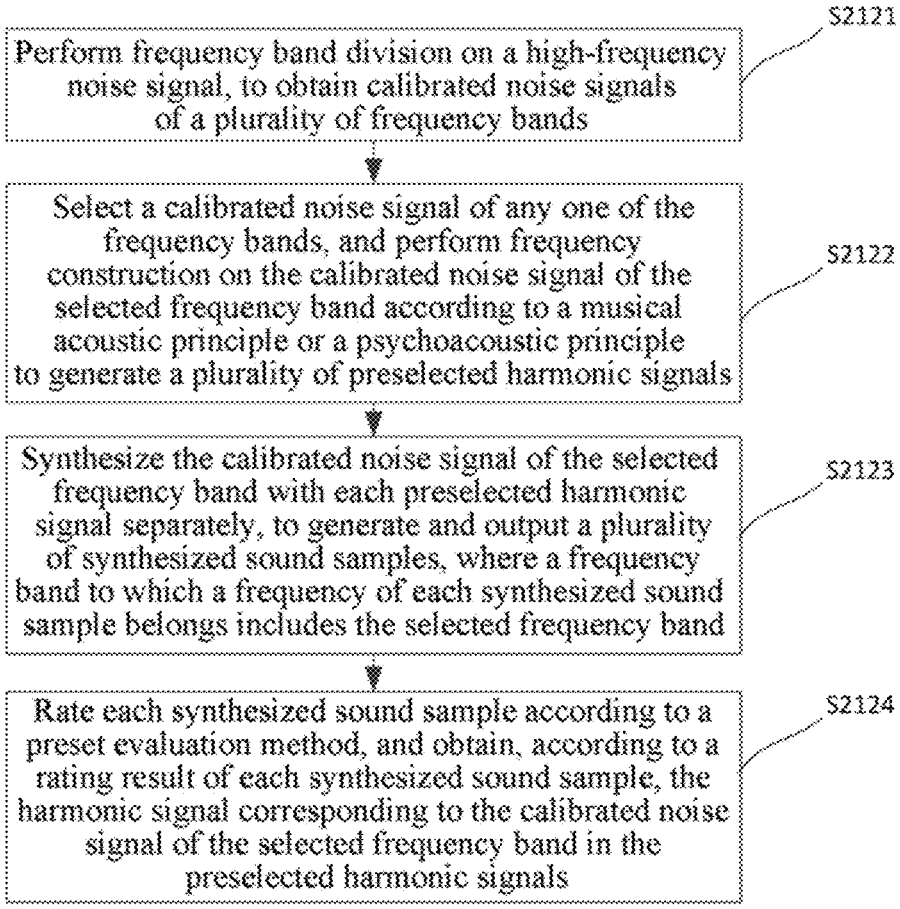
FIG. 6 is a specific schematic flowchart of step S212 in FIG. 5.

As shown in FIG. 6, the sound construction database in step S212 is specifically constructed in the following manner.

Step S2121: Perform frequency band division on the high-frequency noise signal, to obtain calibrated noise signals of a plurality of frequency bands.

The frequency of the motor noise signal may be divided into a high frequency, a low frequency, a constant frequency, a variable frequency, or the like according to the rotational speed of motor. It can be understood that, when the rotational speed of motor is larger, it may correspond to the high-frequency noise, when the rotational speed of motor is smaller, it may correspond to the low-frequency noise, and when a change of the rotational speed of motor is small, that is, when it is basically constant, it may correspond to the constant-frequency noise, and when the rotational speed of motor increases gradually, that is, acceleration exists and is greater than a specific value, it may correspond to the variable-frequency noise.

That the frequency band division is performed on the motor noise signal is to reduce workload when frequency construction is performed. For example, high-frequency components of in-vehicle environmental noise have relatively strong sharpness, and low-frequency components may be added properly when the frequency construction is performed, thereby increasing more intermediate-frequency components.

For example, when the frequency of the motor noise signal is a high frequency, for example, ranging from 3000 to 6000 Hz, a sound at a frequency ranging from 600 to 1000 Hz may be constructed and added to the high-frequency noise.

Step S2122: Select a calibrated noise signal of any one of the frequency bands, and perform frequency construction on the calibrated noise signal of the selected frequency band according to a musical acoustic principle or a psychoacoustic principle to generate a plurality of preselected harmonic signals.

Specifically, for the calibrated noise signal of any one of the frequency bands, and the frequency construction is performed on the noise signal of the frequency band according to the musical acoustic principle or the psychoacoustic principle by using sound processing software (for example, MATLAB) to generate the plurality of preselected harmonic signals Step S2123: Synthesize the calibrated noise signal of the selected frequency band with each preselected harmonic signal separately, to generate and output a plurality of synthesized sound samples, where a frequency band to which a frequency of each synthesized sound sample belongs includes the selected frequency band.

A frequency band to which a frequency of each synthesized sound sample belongs includes the selected frequency band. For example, a low-frequency signal of a frequency band ranging from 400 to 500 Hz is obtained after frequency construction is performed on a noise signal of a frequency band ranging from 4000 to 5000 Hz. A frequency band of a frequency of a synthesized sound sample obtained by synthesizing the two may range from 400 to 6000 Hz. Hence, the frequency band ranging from 400 to 6000 Hz includes the frequency band ranging from 4000 to 5000 Hz. Therefore, compensation may be performed on the frequency of the noise signal of the selected frequency band by using the harmonic signal, to enable coverage of the frequency of the synthesized sound sample to be wider.

Step S2124: Rate each synthesized sound sample according to a preset evaluation method, and obtain, according to a rating result of each synthesized sound sample, the harmonic signal corresponding to the calibrated noise signal of the selected frequency band in the preselected harmonic signals.

The preset evaluation method may include: (1) determining evaluators, where the evaluators should have normal auditory sensation, and may be ordinary working people, and a quantity of the evaluators may be required to be more than 10; (2) rating standards, where a hundred-mark system may be used for rating, and a five-grade evaluation standard is also used, for example, excellent: very pleasant to hear (for example, sounds comfortable, calm, and pleasant) (80 to 100 points), good: pleasant to hear (60 to 80 points), medium: average (40 to 60 points), poor: unpleasant to hear (20 to 40 points), and inferior: very unpleasant to hear (for example, sounds very uncomfortable, disturbing, and irritable) (0 to 20 points), that is, the evaluators can perform hundred-mark system-based rating based on gradation evaluation; (3) audition conditions, for example, audition evaluation can be performed in a relatively quiet in-door environment.

For example, the evaluators include 10 male adults and 10 female adults, and in a relatively quiet in-door environment, each synthesized sound sample corresponding to the selected frequency band is played, and each synthesized sound sample may be played 3 times. After playback is performed 3 times, the 20 evaluators perform rating, and after the rating is completed, mathematical statistics is performed on rating results to select a synthesized sound sample having the highest score (for example, the highest average score). A preselected harmonic signal corresponding to the synthesized sound sample is used as the harmonic signal corresponding to the noise signal of the selected frequency band. Similarly, the harmonic signal corresponding to the noise signal of each frequency band may be obtained, and a set of all the harmonic signals is the foregoing preset sound construction database.

In the manner 2, the harmonic signal is constructed and generated specifically through the following steps:

when the high frequency noise signal includes a fundamental wave and a harmonic wave, obtaining a fundamental frequency from the frequency of the high-frequency noise signal, and obtaining the harmonic signal by the generating function according to the musical acoustic or psychoacoustic principles, where the harmonic signal is a subharmonic wave of the fundamental wave in the high-frequency noise signal, a frequency of the harmonic signal is $$\frac{n}{m}$$

of the fundamental frequency, and n and m are natural numbers, n is less than m. For example, an interval of which a frequency ratio in the musical acoustics is 2:1 is octave, and belongs to a consonant interval. Frequency ratios of other intervals are that: minor second is 16:15, major second is 9:8, minor third is 6:5, major third is 5:4, perfect fourth is 4:3, augmented fourth is 45:32, diminished fifth is 64:45, perfect fifth is 3:2, minor sixth is 8:5, major sixth is 5:3, minor seventh is 16:9, and the like A perfect consonant interval in a music theory includes perfect unison, perfect octave, perfect fifth, and perfect fourth. The subjective feeling of the perfect consonant interval is the best. As an example, in the minor second, the frequency of the harmonic signal is $$\frac{15}{16}$$

of the fundamental frequency, in the major second, the frequency of the harmonic signal is $$\frac{8}{9}$$

of the fundamental frequency, in the minor third, the frequency of the harmonic signal is $$\frac{5}{6}$$

of the fundamental frequency, in the major third, the frequency of the harmonic signal is $$\frac{4}{5}$$

of fundamental frequency, in the perfect fourth, the frequency of the harmonic signal is $$\frac{3}{4}$$

or me fundamental frequency, in the augmented fourth, the frequency of the harmonic signal is $$\frac{32}{45}$$

of the fundamental frequency, in the diminished fifth, the frequency of the harmonic signal is $$\frac{45}{64}$$

of the fundamental frequency, in the perfect fifth, the frequency of the harmonic signal is $$\frac{2}{3}$$

of the fundamental frequency, in the minor sixth, the frequency of the harmonic signal is $$\frac{5}{8}$$

of the fundamental frequency, in the major sixth, the frequency of the harmonic signal is $$\frac{3}{5}$$

of the fundamental frequency, and in the minor seventh, the frequency of the harmonic signal is $$\frac{9}{16}$$

of the fundamental frequency.

In this example, a generating function expression of the harmonic signal is: $Y=Ky+b$, and $y=a\sin(2*\pi*A*f*t)$, where K represents a slope of the frequency, a represents an amplitude of the harmonic signal, A represents a harmonic coefficient, f represents the frequency of the harmonic signal, and t represents a time. When the high-frequency noise is a constant-frequency howl, for example, it is known that a constant frequency of a motor howl is f=5050 Hz, and it is assumed that the signal is a sine signal. Through researches, it is found that for the motor noise signal at the frequency, the subjective feeling of constructing the octave interval harmonic component is the best. Therefore, the sine signal at the frequency of f/2=2525 Hz is generated as the harmonic signal. K is 1, and b is 0. If it is known that the motor howl is a frequency increasing linearly from 3500 Hz to 4300 Hz, the generating function is the linear gradient function.

In a preferred manner, when the harmonic signal is generated, a frequency of noise other than the high-frequency noise signal serving as target noise in the environment may also be considered, and whether the harmonic signal overlaps another noise component is considered. If the harmonic signal overlaps the another noise component, a frequency component of an overlap may no longer be constructed when the harmonic signal is constructed. In this way, a problem that a signal that is constructed and generated according to only a frequency of a single motor noise signal is likely to form, together with another non-motor noise component, a new enhanced noise signal due to overlapping, interference, and the like, resulting in degradation of acoustic environment quality, is avoided, thereby greatly improving the acoustic environment quality.

The following describes in detail how to generate a masking signal in step S22.

A function and a generation mechanism of the masking signal are explained as follows. The masking signal functions as follows: a phenomenon that a stronger sound conceals a weaker sound and makes the weaker sound inaudible is referred to as a "masking effect". When two or more sounds are listened to at the same time, an auditory system produces the so-called "masking effect", that is, each pure tone becomes more inaudible or inaudible, or the pure tone is partially or completely "masked". This characteristic is used to generate a "masking signal" for the high-frequency noise to enable the "masking signal" to make the high-frequency noise signal inaudible. The frequency of the "masking signal" is lower than that of the noise signal. In this way, on the one hand, the "masking effect" can mask the noise signal, on the other hand, the "masking effect" can also slightly reduce the sharpness, or at least does not increase the sharpness. Therefore, for the masking signal, on the one hand, the frequency of the masking signal is required to be lower than that of the high-frequency noise signal. In addition, a variation tendency of the sound pressure level of the masking signal is consistent with that of the sound pressure level of the harmonic signal. The so-called variation tendency consistency means that the variation tendency matches the tendency of the sound pressure level of the harmonic signal. For example, assuming that the sound pressure level of the harmonic signal, as a whole, decreases linearly, the masking signal need also to decrease relative to the pitch of the high-frequency noise signal. However, it should be noted that the reduced amplitude does not need to be consistent with the reduced amplitude of the harmonic signal. If the sound pressure level of the harmonic signal is kept consistent, the sound pressure level of the masking signal is also kept consistent relative to the sound pressure level of the high-frequency noise signal.

Figure 7:
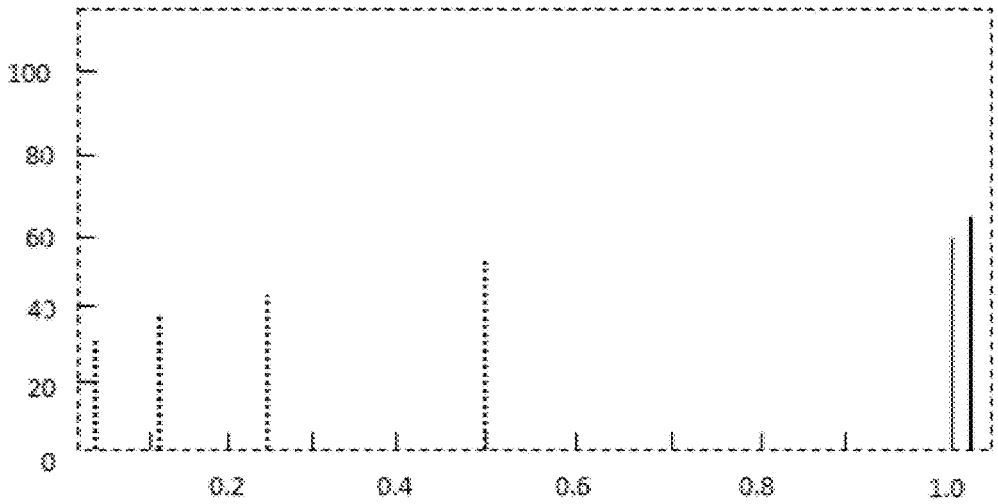
FIG. 7 is a schematic diagram of a frequency spectrum of constructing a masking signal and a harmonic signal according to a specific implementation of the present disclosure.
Figure 8:
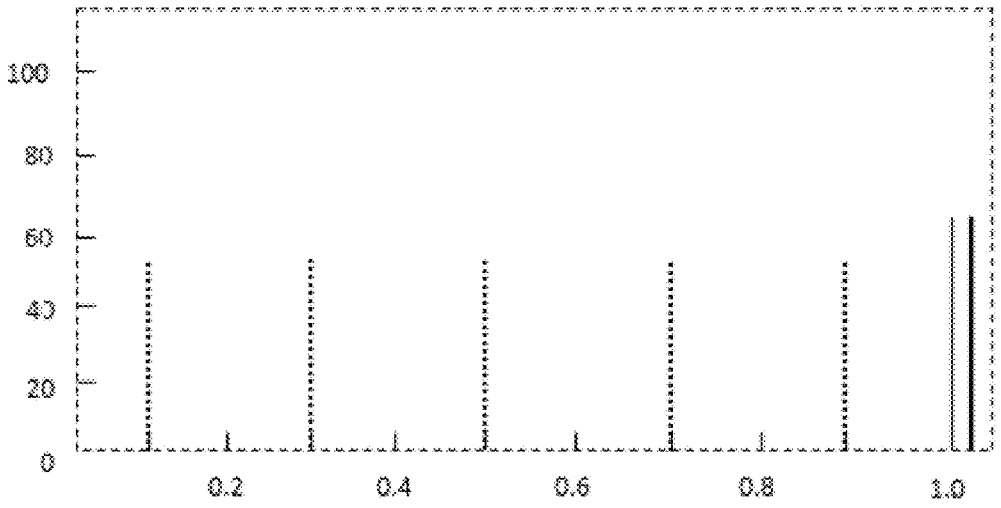
FIG. 8 is a schematic diagram of another frequency spectrum of constructing a masking signal and a harmonic signal according to a specific implementation of the present disclosure.

As shown in FIG. 7 and FIG. 8, a horizontal axis represents a frequency, a vertical axis represents a relative sound pressure level, a thick solid line represents a high-frequency noise signal, a thin solid line represents a masking signal, and a dashed line represents a harmonic signal. As shown in FIG. 7, the harmonic signal shown by the dashed line is an "octave" subharmonic wave of the high-frequency noise signal, a frequency of the subharmonic wave and a frequency of the high-frequency noise signal always meet a relationship of 1:2, and a frequency of the masking signal is slightly lower than that of the high-frequency noise signal. In this example, a sound pressure level of the subharmonic wave, as a whole, decreases linearly. Therefore, a sound pressure level of the masking signal is relatively lower than a sound pressure level of the high-frequency noise signal, so that the masking signal is used to mask the noise signal.

As shown in FIG. 8, the harmonic signal shown by the dashed line is an odd-number subharmonic wave of the high-frequency noise signal, a frequency of the subharmonic and a frequency of the high-frequency noise signal always meet an odd-number relationship, and a frequency of the masking signal is slightly lower than that of the high-frequency noise signal. In this example, loudness of subharmonic signals is the same, but is less than that of the noise signal. The sound pressure level of the masking signal is set to be the same as the sound pressure level of the high-frequency noise signal.

It should be noted that in different combination manners, the frequency relationship between, loudness of, and harmonic orders of the high-frequency noise signal, the masking signal, and the harmonic signal are all different, and their subjective feelings are also different. A combination with the best subjective feeling may be selected through experiments. Details are not described herein, and only a specific construction method is described.

For example, the masking signal may be obtained in the following manner. presetting N frequencies for candidate masking signals, synchronously playing the candidate masking signals and the high-frequency noise signal one by one, and performing subjective evaluation, to select a candidate masking signal with the best subjective evaluation as the masking signal, where the N preset frequencies are all lower than the frequency of the high-frequency noise signal, and a variation tendency of a sound pressure level of the masking signal is consistent with a variation tendency of a sound pressure level of the harmonic signal.

Alternatively, in a preferred manner, a plurality of sound pressure levels may be set, and subjective evaluation may be performed in combination. Specifically, N frequencies and M preselected sound pressure levels are preset, the N frequencies with the M preselected sound pressure levels are combined to generate N*M candidate masking signals, the N*M candidate masking signals and the high frequency noise signal are synchronously played one by one, and subjective evaluation is performed, to select a candidate masking signal with the best subjective evaluation as the masking signal, where a sound pressure level of the candidate masking signal is lower than the sound pressure level of the high frequency noise signal, and the N preset frequencies are all lower than the frequency of the high frequency noise signal.

A range of the N frequencies is [f0-a, f0-b], f0 is the frequency of the high frequency noise signal, the three meet the following expression: f0>a>b, and a and b are empirical values.

For example, assuming that in the foregoing expression, a=150 Hz and b=50 Hz, in the frequency range that is lower than the frequency of the high-frequency noise signal by [50, 150], N=10 is selected, and 10 candidate masking signals are generated at a step size of 10 Hz. The foregoing 10 candidate masking signals are played together with the high-frequency noise signals for subjective evaluation, and a group with the best subjective evaluation is selected.

Step S3: Input the harmonic masking signal into a sound playback apparatus for playback, to output a noise reduction construction sound and to perform noise reduction on the acoustic environment. For example, in the new energy vehicle, a sound is played by the sound playback apparatus to perform noise reduction on a high frequency noise signal of the new energy vehicle.

The active noise reduction method disclosed by the present disclosure is applicable to performing active noise reduction in any high frequency noise environment. On the one hand, a subharmonic signal of the high frequency noise signal is constructed as the harmonic signal. In addition, the masking signal at a frequency close to the frequency of the high-frequency noise signal is added to harmonic signal for masking the high-frequency noise signal. Adding a subharmonic wave can reduce a ratio of a high-frequency component of noise in an entire frequency domain, and the high-frequency component reflects an annoyance degree. Therefore, the annoyance degree is reduced. Moreover, adding the masking signal can make the high-frequency noise signal unclear, and therefore, also reduce the annoyance degree. In this way, sound quality of an acoustic environment may be further improved. In addition, the method is simple and easy to operate and has low costs.

Figure 9:
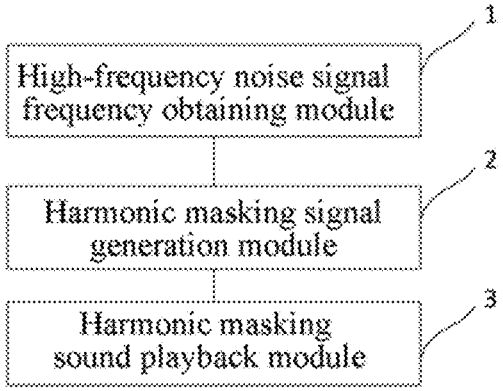
FIG. 9 is a structural block diagram of an active noise reduction system according to a specific implementation of the present disclosure.

A second embodiment of the present disclosure discloses an active noise reduction system. As shown in FIG. 9, the active noise reduction system includes the following modules: a high-frequency noise signal frequency obtaining module 1, configured to obtain a frequency of a high-frequency noise signal in an acoustic environment; a harmonic masking signal generation module 2, configured to construct and generate a harmonic masking signal according to the frequency of the high-frequency noise signal, where the harmonic masking signal includes a harmonic signal and a masking signal, and the harmonic signal is a subharmonic wave of the high-frequency noise signal; and a harmonic masking sound playback module 3, configured to input the harmonic masking signal into a sound playback apparatus for playback, to enable the harmonic masking signal to act with the high-frequency noise signal in the acoustic environment and to perform noise reduction on the acoustic environment.

The active noise reduction system is applicable to various acoustic environments in which high-frequency noise reduction needs to be performed. Particularly, the active noise reduction system is configured to perform noise reduction on high-frequency noise of a motor in a new energy vehicle.

The high-frequency noise signal obtaining module usually includes an acoustic environmental noise capturing apparatus. The acoustic environmental noise capturing apparatus usually is a microphone. By using the new energy vehicle as an example, the microphone may be a built-in apparatus of the new energy vehicle or an added microphone on the basis of a built-in microphone of the new energy vehicle. The acoustic environmental noise capturing apparatus is disposed in a cab or a passenger cab of the new energy vehicle. Acoustic environmental noise of the cab and space in which passengers are located is mainly captured. For example, the acoustic environmental noise capturing apparatus is usually mounted on a center console in front of the cab and the passenger cab. Alternatively, the acoustic environmental noise capturing apparatus may be mounted at a position that is in a motor compartment and that is close to a motor. The high-frequency noise signal needs to be extracted after noise signals are captured, to obtain the frequency of the high-frequency noise signal.

Figure 10:
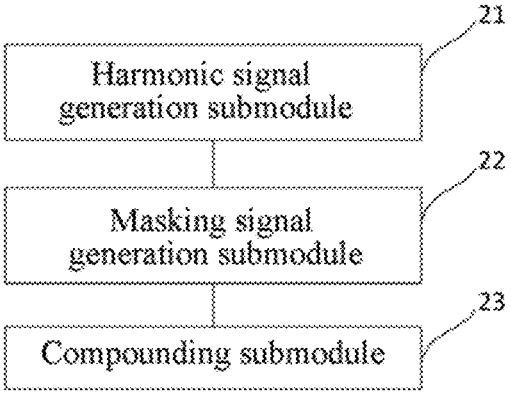
FIG. 10 is a specific structural block diagram of a harmonic masking signal generation module in FIG. 9.

As shown in FIG. 10, the harmonic masking signal generation module 2 specifically includes: a harmonic signal generation submodule 21, configured to construct and generate a harmonic signal according to the frequency of the high-frequency noise signal; a masking signal generation submodule 22, configured to construct and generate a masking signal according to the frequency of the high-frequency noise signal; and a compounding module 23, configured to compound the harmonic signal and the masking signal to obtain the harmonic masking signal.

The harmonic masking sound playback module may be various devices that can play audio and that is known to a person skilled in the art. By using the new energy vehicle field as an example, the harmonic masking sound playback module may be an additionally disposed speaker device, and may be disposed in a passenger compartment in which a driver or passengers are located, for example, on the center console in the cab and the passenger cab. Alternatively, a sound playback apparatus of the harmonic masking sound playback module is disposed close to the motor, that is, a noise source. Therefore, after the harmonic masking signal is played, a source and a path that are the same as those of the motor noise signal can be ensured, uncertain factors, such as generated attenuation of the harmonic masking signal in a propagation process, are eliminated, and a noise reduction effect of fusion of the harmonic masking signal and the motor noise signal on an in-vehicle environment (that is, the acoustic environment) is improved. Alternatively, the harmonic masking sound playback module may also be a speaker device in the new energy vehicle. For example, the harmonic masking sound playback module is a vehicle-mounted acoustic device in the new energy vehicle.

It should be noted that, for other specific implementations of the active noise reduction system, refer to the specific implementations of the active noise reduction method according to the foregoing first embodiment of the present disclosure. To avoid repetition, details are not described herein again.

The active noise reduction system disclosed by the present disclosure is applicable to performing active noise reduction in any high-frequency noise environment. On the one hand, a subharmonic signal of the high-frequency noise signal is constructed as the harmonic signal. In addition, the masking signal at a frequency close to the frequency of the high-frequency noise signal is added to harmonic signal for masking the high-frequency noise signal. Adding a subharmonic wave can reduce a ratio of a high-frequency component of noise in an entire frequency domain, and the high-frequency component reflects an annoyance degree. Therefore, the annoyance degree is reduced. Moreover, adding the masking signal can make the high-frequency noise signal unclear, and therefore, also reduce the annoyance degree. In this way, sound quality of an acoustic environment may be further improved. In addition, the system is simple and easy to implement and has low costs.

Figure 11:
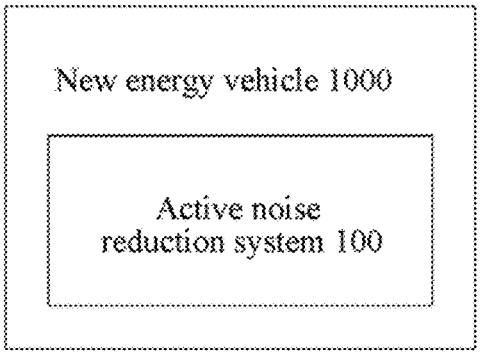
FIG. 11 is a schematic diagram according to a specific implementation of the present disclosure.

As shown in FIG. 11, a third embodiment of the present disclosure discloses a new energy vehicle 1000, including the active noise reduction system 100 disclosed in the foregoing second embodiment.

Because in this example, only the active noise reduction system 100 of the new energy vehicle 1000 is improved, no other structure and system improvements are involved, and the active noise reduction system 100 and the active noise reduction method have been described in the first embodiment and the second embodiment, to avoid repetition, details are not described herein again.

Because the new energy vehicle 1000 disclosed by the present disclosure is provided with the active noise reduction system 100, noise reduction is performed on the high-frequency motor noise of the new energy 1000. On the one hand, a subharmonic signal of the high-frequency noise signal is constructed as the harmonic signal. In addition, the masking signal at a frequency close to the frequency of the high frequency noise signal is added to harmonic signal for masking the high-frequency noise signal. Adding a subharmonic wave can reduce a ratio of a high-frequency component of noise in an entire frequency domain, and the high-frequency component reflects an annoyance degree. Therefore, the annoyance degree is reduced. Moreover, adding the masking signal can make the high-frequency noise signal unclear, and therefore, also reduce the annoyance degree. In this way, sound quality of an acoustic environment in the new energy vehicle may be further improved. In addition, the system is simple and easy to implement and has low costs.

The foregoing descriptions are merely preferred embodiments of the present disclosure, but are not intended to limit the present disclosure. Any modification, equivalent replacement, or improvement made within the spirit and principle of the present disclosure shall fall within the protection scope of the present disclosure.

What is claimed is:

1. An active noise reduction method, comprising:

obtaining a frequency of a high-frequency noise signal in an acoustic environment;

constructing and generating a harmonic masking signal according to the frequency of the high-frequency noise signal, wherein the harmonic masking signal comprises a harmonic signal and a masking signal, and the harmonic signal is a subharmonic wave of the high-frequency noise signal; and inputting the harmonic masking signal into a sound playing device for playing, to output a noise reduction construction sound and to perform noise reduction on the acoustic environment.

2. The active noise reduction method according to claim 1, wherein the obtaining a frequency of a high-frequency noise signal in an acoustic environment comprises:

capturing acoustic environmental noise in the acoustic environment, to obtain a noise signal; and extracting the high-frequency noise signal from the noise signal, to obtain the frequency of the high-frequency noise signal.

3. The active noise reduction method according to claim 1, wherein the obtaining a frequency of a high-frequency noise signal in an acoustic environment comprises:

capturing a related operational parameter of a noise source making high-frequency noise in the acoustic environment, and obtaining a frequency of a corresponding high-frequency noise signal according to the operational parameter, wherein the operational parameter and the frequency of the high-frequency noise signal have a correspondence.

4. The active noise reduction method according to claim 1, wherein the noise source is a new energy vehicle, and the obtaining a frequency of a high-frequency noise signal in an acoustic environment comprises:

capturing an operational parameter of the new energy vehicle, and obtaining a frequency of a high-frequency noise signal associating with the operational parameter according to the operational parameter, wherein the operational parameter at least comprises a rotational speed of motor of the new energy vehicle, and the rotational speed of motor and the frequency of the high-frequency noise signal have a correspondence.

5. The active noise reduction method according to claim 1, wherein the constructing and generating a harmonic masking signal according to the frequency of the high-frequency noise signal comprises:

constructing and generating a harmonic signal according to the frequency of the high-frequency noise signal;

constructing and generating a masking signal according to the frequency of the high-frequency noise signal; and compounding the harmonic signal and the masking signal to obtain the harmonic masking signal.

6. The active noise reduction method according to claim 5, wherein the constructing and generating a masking signal according to the frequency of the high-frequency noise signal comprises:

presetting N frequencies for candidate masking signals, synchronously playing the candidate masking signals and the high-frequency noise signal one by one, and performing subjective evaluation, to select a candidate masking signal with the best subjective evaluation as the masking signal, wherein the N preset frequencies are all lower than the frequency of the high-frequency noise signal, and a variation tendency of a sound pressure level of the masking signal is consistent with a variation tendency of a sound pressure level of the harmonic signal.

7. The active noise reduction method according to claim 6, wherein a range of the N frequencies is [f0-a, f0-b], f0 is the frequency of the high-frequency noise signal, wherein f0, a, b are satisfied: f0>a>b, wherein a and b are empirical values.

8. The active noise reduction method according to claim 5, wherein the constructing and generating a masking signal according to the frequency of the high-frequency noise signal comprises:

presetting N frequencies and M preselected sound pressure levels, combining the N frequencies with the M preselected sound pressure levels to generate N*M candidate masking signals, synchronously playing the N*M candidate masking signals and the high-frequency noise signal one by one, and performing subjective evaluation, to select a candidate masking signal with the best subjective evaluation as the masking signal, wherein a sound pressure level of the candidate masking signal is lower than the sound pressure level of the high-frequency noise signal, and the N preset frequencies are all lower than the frequency of the high-frequency noise signal.

9. The active noise reduction method according to claim 1, wherein the constructing and generating a harmonic signal according to the frequency of the high-frequency noise signal comprises:

obtaining a harmonic signal corresponding to the high-frequency noise signal by invoking a preset sound construction database according to the frequency of the high-frequency noise signal; or obtaining a harmonic signal corresponding to the motor noise signal by using a generating function according to the frequency of the high-frequency noise signal.

10. The active noise reduction method according to claim 9, wherein the obtaining, according to the frequency of the high-frequency noise signal, the harmonic signal corresponding to the high-frequency noise signal by invoking a preset sound construction database comprises:

determining a frequency band of the high-frequency noise signal according to the frequency of the high-frequency noise signal; and invoking the preset sound construction database according to the frequency band of the high-frequency noise signal, to obtain the harmonic signal corresponding to the frequency band of the high-frequency noise signal, wherein the preset sound construction database stores a plurality of harmonic signal samples, and each harmonic signal sample corresponds to a noise frequency band, and comprises the harmonic signal corresponding to the noise frequency band.

11. The active noise reduction method according to claim 10, wherein the preset sound construction database is obtained by:

performing frequency band division on the high-frequency noise signal, to obtain calibrated noise signals of a plurality of frequency bands;

selecting a calibrated noise signal of any one of the frequency bands, and performing frequency construction on the calibrated noise signal of the selected frequency band according to a musical acoustic principle or a psychoacoustic principle to generate a plurality of preselected harmonic signals;

synthesizing the calibrated noise signal of the selected frequency band with each preselected harmonic signal separately, to generate and output a plurality of synthesized sound samples, wherein a frequency band to which a frequency of each synthesized sound sample belongs comprises the selected frequency band; and rating each synthesized sound sample according to a preset evaluation method, and selecting, according to a rating result of each synthesized sound sample, the harmonic signal corresponding to the calibrated noise signal of the selected frequency band from the preselected harmonic signals.

12. The active noise reduction method according to claim 9, wherein the preset sound construction database is obtained by:

performing frequency band division on the high-frequency noise signal, to obtain calibrated noise signals of a plurality of frequency bands;

selecting a calibrated noise signal of any one of the frequency bands, and performing frequency construction on the calibrated noise signal of the selected frequency band according to a musical acoustic principle or a psychoacoustic principle to generate a plurality of preselected harmonic signals;

synthesizing the calibrated noise signal of the selected frequency band with each preselected harmonic signal separately, to generate and output a plurality of synthesized sound samples, wherein a frequency band to which a frequency of each synthesized sound sample belongs comprises the selected frequency band; and rating each synthesized sound sample according to a preset evaluation method, and selecting, according to a rating result of each synthesized sound sample, the harmonic signal corresponding to the calibrated noise signal of the selected frequency band from the preselected harmonic signals.

13. An active noise reduction system, comprising:

a high frequency noise signal frequency obtaining module, to obtain a frequency of a high-frequency noise signal in an acoustic environment;

a harmonic masking signal generation module, to construct and generate a harmonic masking signal according to the frequency of the high-frequency noise signal, wherein the harmonic masking signal comprises a harmonic signal and a masking signal, and the harmonic signal is a subharmonic wave of the high-frequency noise signal; and a harmonic masking sound playback module, to input the harmonic masking signal into a sound playing device for playing, to enable the harmonic masking signal to act with the high-frequency noise signal in the acoustic environment and to perform noise reduction on the acoustic environment.

14. The active noise reduction system according to claim 13, wherein the harmonic masking signal generation module comprises:

a harmonic signal generation submodule, to construct and generate a harmonic signal according to the frequency of the high-frequency noise signal;

a masking signal generation submodule, to construct and generate a masking signal according to the frequency of the high-frequency noise signal; and a compounding module, to compound the harmonic signal and the masking signal to obtain the harmonic masking signal.

15. A new energy vehicle, comprising the active noise reduction system according to claim 13.

* * * * *